US005123137A

United States Patent [19]

McCauley

[11] Patent Number: 5,123,137

[45] Date of Patent: Jun. 23, 1992

[54] ADJUSTABLE SQUEEGIE DEVICE

[76] Inventor: R. Paul McCauley, 4620 Lucerne Rd., Indiana, Pa. 15701

[21] Appl. No.: 563,269

[22] Filed: Aug. 2, 1990

[51] Int. Cl.[5] ..... A47L 1/06

[52] U.S. Cl. ..... 15/105; 15/143 R; 15/172; 15/245; 16/110 R

[58] Field of Search ..... 15/245, 105, 106, 147 C, 15/111, 150, 114, 151, 118, 152, 117, 154, 162, 143 R, 177, 144 R, 121, 220 R, 119 R, 119 A, 214 R, 247, 172; 16/110 R; 7/167, 168; 81/177.1

[56] References Cited

U.S. PATENT DOCUMENTS

| | | | |
|---|---|---|---|
| 730,843 | 6/1903 | Rostek | 15/245 |
| 834,667 | 1/1906 | Flynn . | |
| 1,097,906 | 5/1914 | Beauchesne | 15/111 |
| 1,293,257 | 2/1919 | Vargha | 15/172 |
| 1,633,119 | 6/1927 | MacKay . | |
| 1,776,277 | 9/1930 | Battocletti | 15/162 |
| 1,984,154 | 12/1934 | Pilato | 15/247 X |
| 2,681,464 | 6/1954 | Barie | 15/144 |
| 2,733,467 | 2/1956 | Garro | 15/119 A |
| 2,768,398 | 10/1956 | Karlitsky | 15/119 A |
| 2,824,328 | 2/1958 | Bedford | 15/230 |
| 2,904,806 | 9/1959 | Obergfell | 15/105 |
| 3,038,188 | 6/1962 | Rebernak | 15/119 A |
| 3,069,195 | 12/1962 | Buck | 15/150 |
| 3,624,855 | 12/1971 | Shaw | 15/118 |
| 3,789,451 | 2/1974 | Laitner | 15/118 |
| 4,312,093 | 1/1982 | Raab | 15/121 |
| 4,776,716 | 10/1988 | Huang | 15/172 X |
| 4,908,900 | 3/1990 | McLaughlin et al. | 15/105 X |

FOREIGN PATENT DOCUMENTS

| | | | |
|---|---|---|---|
| 61272 | 3/1892 | Fed. Rep. of Germany | 15/210 R |
| 244055 | 2/1912 | Fed. Rep. of Germany . | |
| 7638436 | 5/1977 | Fed. Rep. of Germany . | |
| 729823 | 5/1932 | France . | |
| 541861 | 4/1956 | Italy | 15/114 |
| 129431 | 9/1950 | Sweden | 15/150 |
| 644915 | 8/1984 | Switzerland | 15/150 |

*Primary Examiner*—Harvey C. Hornsby
*Assistant Examiner*—C. Cooley
*Attorney, Agent, or Firm*—Lisa M. Morgan

[57] ABSTRACT

A device for cleaning opposing surfaces such as a truck rear cab window and opposing cap front window. An elongated shaft having a handle-like assembly which operated to open and close the cleaning assembly, thus allowing the device in its closed position to be inserted into narrow junctions between opposing surfaces and subsequently opened to an angle conforming to the space between the various opposing surfaces to be cleaned. In addition, a ball and cup mechanism allows the cleaning members to continuously adjust without manual intervention, thus permitting uniform cleaning of various surfaces. The device can also be used for other applications, such as painting.

6 Claims, 2 Drawing Sheets

ADJUSTABLE SQUEEGIE DEVICE

BACKGROUND AND SUMMARY OF THE INVENTION

The present invention generally relates to window cleaning devices, and, more particularly, to such devices which allow for cleaning between opposing surfaces. The device can also be adapted for other uses, such as painting, and the like.

There is widespread use of window cleaning devices, both professionally and by individuals. Current devices predominantly allow only for the cleaning of a single smooth surface. There is a need, however, for equipment which will facilitate the cleaning of opposing surfaces simultaneously and uniformly. For example, a rear truck cab windshield and opposing cap windshield. The present device satisfies this need. Another object of the invention is to allow for cleaning two opposing surfaces between which there is a narrow junction. A further object of the invention is to provide for flexible and continuous adjustment of the cleaning heads on the surfaces without manual intervention to allow for thorough and uniform cleaning. Another feature of the invention is the particular manner in which the cleaning heads function to clean opposing surfaces. Still another object of the present invention is to provide a portable, durable, cleaning device capable of being manufactured on an economical basis. Yet another object is to provide a cleaning device easy to use for various applications. Additional objects and features of this invention will become more apparent in the detailed description and accompanying drawings.

The device basically consists of an elongated shaft having a handle-like assembly at its one end for us in holding and controlling the device and a cleaning assembly at its other end. The elongated shaft contains support rods running the length of its exterior on either side of the shaft, which rods function to control the opening and closing of the cleaning assembly.

The cleaning assembly consists of two opposing hinge plates attached to the shaft by means of a hinge mechanism and pin. The hinge plates house a spring which allows the cleaning assembly to adjust to a suitable angle for cleaning various surfaces; for example, a 45° angle. The extent of the extension of the cleaning assembly is limited to an angle of 90° and is determined by the configuration of the opposing surfaces to be cleaned. At its extreme end, each plate contains a cup-like member which houses a ball-type member. This ball-type member is part of the cleaning head. Once extended, the ball and cup-type mechanism allows for continuous adjustment of the cleaning surface, and thus, uniformity of cleaning. The rods, which run the length of the shaft, extend over the exterior of the opposing hinge plates, thus forcing them into a closed position.

The handle-like assembly consists of a front member, which is stationary and perpendicular to the elongated shaft. The rear member of the handle assembly is movable and is connected to the shaft by means of a fastening mechanism. The rear and front handle members are pivotally connected and house a spring member. This pivot and spring mechanism forces the two handle members into an open, resting position. When pressure is applied by the operator to the rear member, thus moving it forward toward the front, stationary member, the fastening mechanism forces the support rods rearward, thus releasing the pressure from the outside of the two opposing hinge plates of the cleaning assembly. This absence of pressure allows the plates to extend outwardly via the hinge mechanism and causes the cleaning assembly to open to an angle conforming to the surfaces to be cleaned. Thus, the operator can easily command the opening and closing of the cleaning surfaces by applying and releasing pressure to the handle-like assembly.

The device is also capable of other applications by merely replacing the cleaning head component with, for example, painting surfaces, or rollers. Thus, the device can easily be adapted for other uses.

DETAILED DESCRIPTION OF THE INVENTION

FIGS. 1-10

Now, referring more particularly to FIGS. 1-10 of the drawings, which illustrate the preferred embodiment of the present invention, the device consists of an elongated shaft 1 having a series of support guides 3 integrally molded along both sides of its length and a opening 7 at its one end. The shaft may be made of any metal or plastic material, or any other suitable rigid material. In the present instance, it is shown as being made of a rigid plastic material with the support guides molded as part of the shaft.

Figures 1, 2, 3, 4:
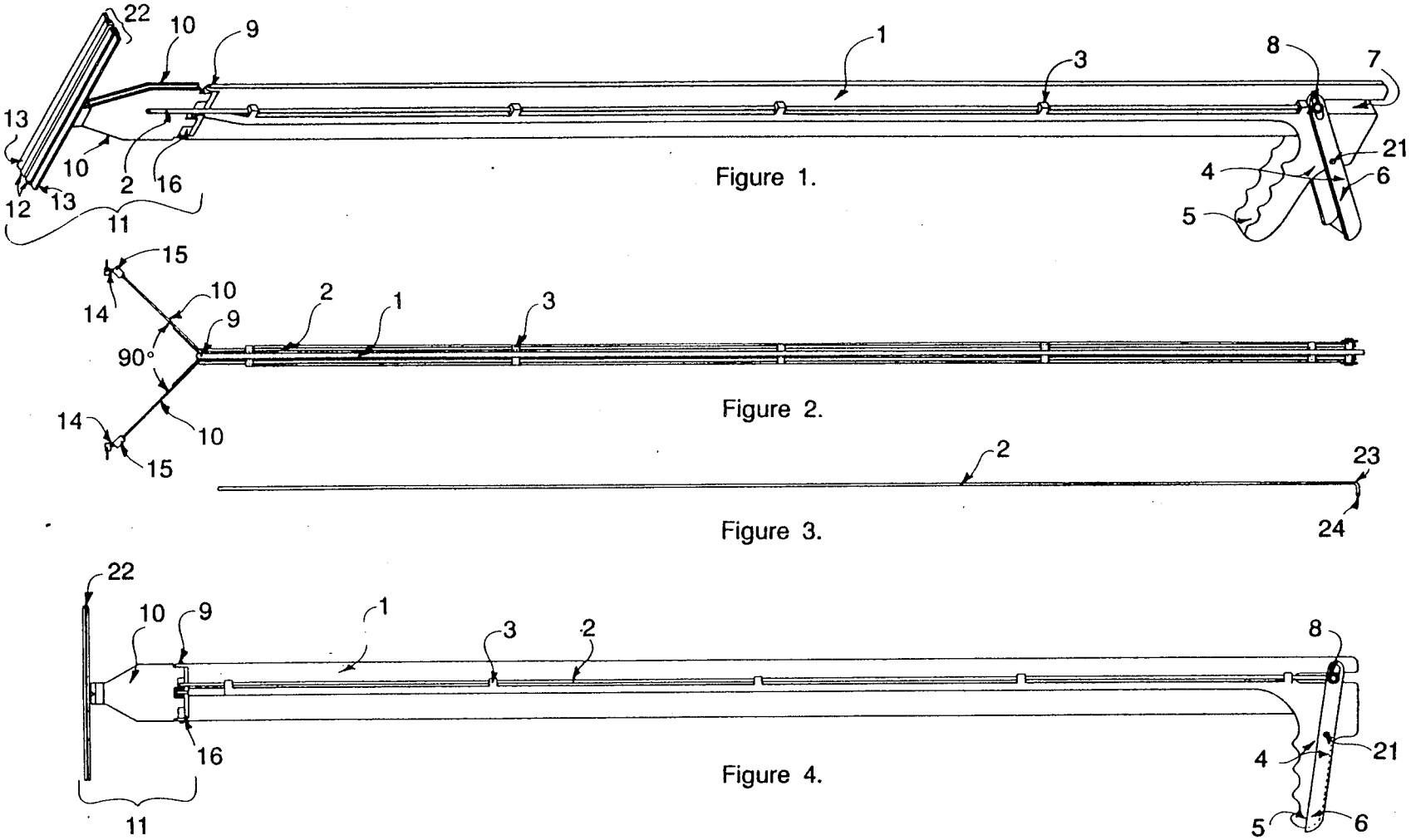
FIG. 1 is an angular view of the preferred embodiment of the complete assembly of the present invention illustrating the device in a resting position.
FIG. 2 is a top view of the complete assembly of FIG. 1 and illustrates the cleaning assembly in an open, extended position.
FIG. 3 is a side view of a typical support rod.
FIG. 4 is a side view of the complete assembly of FIG. 1 and FIG. 2 illustrating the cleaning assembly in an operational position.

The series of guides 3 on either side of the shaft each house a cylindrical rod 2, which may be made of metal, plastic, or any sufficiently rigid material. The cylindrical rod lies parallel along the exterior of the entire length of the shaft as is shown in FIG. 1. The cylindrical rod 2 has at its one end a perpendicular arm or extension 23 at an approximate right angle to its length and which serves to secure the rod to one end of the shaft by means of a fastening mechanism 8.

Figure 8:
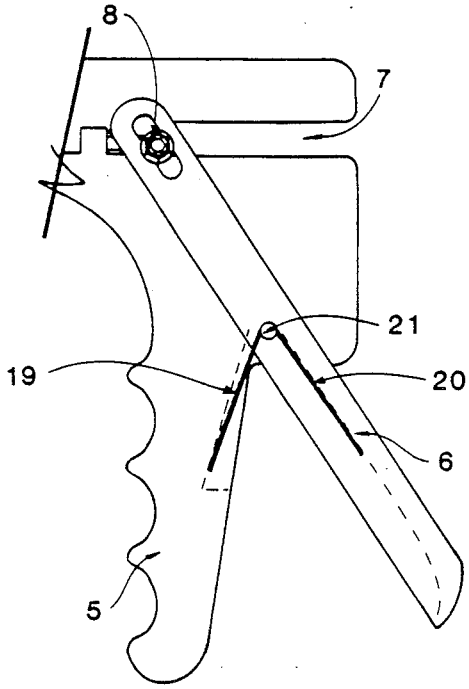
FIG. 8 is a side view of the preferred embodiment of the handle-like assembly and pivot pin and spring mechanism of the present invention.

At its one end, the shaft has a handle-like assembly 4 as is depicted in FIG. 8 and which consists of a forward integrally molded, stationary member 5 and a rear, movable member 6. In the preferred embodiment of the device, the forward member 5 is molded as part of the shaft 1. The rear member 6 has an opening, or slot, at its top and is connected to the shaft by means of a fastening mechanism 8. The rear member is pivotally connected to the front member by means of a pivot pin 21 which allows the top portion of rear member to pivot rearward when pressure is applied by the operator, thus moving the bottom portion of the rear member forward, toward the front, stationary member.

As can be seen in FIG. 8, a fastening mechanism 8, serves to secure the cylindrical rods and consists of an opening or slot in the rear member 6 through which the perpendicular arm 23 of the cylindrical rod 2 is positioned. A cap, or other anchoring component, is placed over the end 24 of the perpendicular arm 23 of each rod 2, thereby securing it in place, and attaching the rods to the rear member 6 of handle assembly 4. Thus, when the operator applies pressure to the handle assembly, forcing the rear member 6 forward, the top portion of the rear member pivots rearward pulling the rods rearward along with it and removing the rods from the exterior of the hinge plates.

Figure 6:
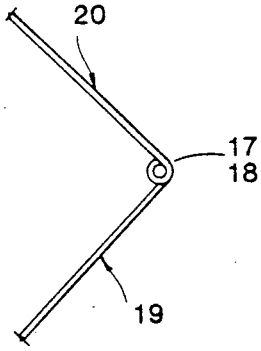
FIG. 6 is a top view of a typical spring used in the handle-like mechanism and hinge plates of the complete device shown in FIG. 1 and FIG. 4.
Figure 7:
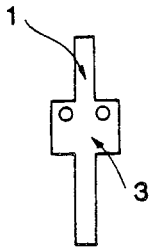
FIG. 7 is a cross section of the elongated shaft member illustrating the positioning of the rods supported by guides along the length of the shaft's exterior.

A spring 18 is housed in the handle assembly as is also shown in FIG. 8. In the preferred embodiment, the typical spring as depicted in FIG. 6 has two arms 19 and 20. The spring is positioned so that one arm is housed in each of the forward and rear handle members, thus forcing them into an open, resting position. Consequently, the spring should be made of metal, or a sufficiently rigid and durable material.

Figure 5:
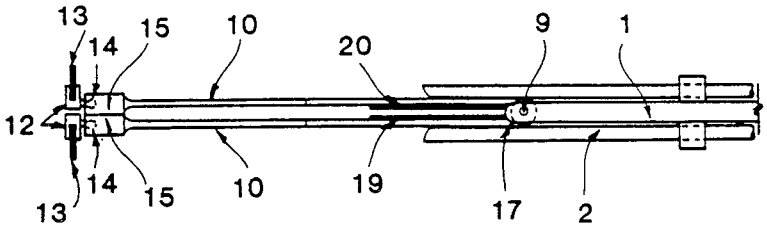
FIG. 5 is a top view of the cleaning assembly and hinge plates.
Figure 9:
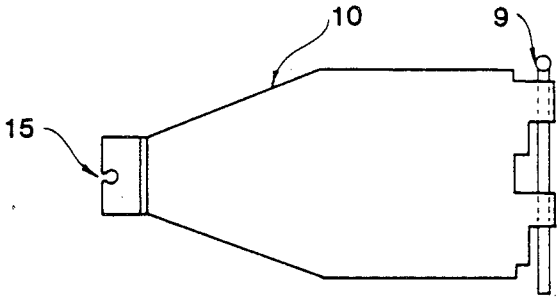
FIG. 9 is a side view of hinge plate of the present invention.

The opposite end of the shaft 1 consists of a cleaning assembly 11 as is shown in FIG. 4. The cleaning assembly consists of two opposing hinge plates 10 and the cleaning head 22 and is connected to the shaft by means of a hinge mechanism 16. The hinge mechanism consists of a series of openings in the rear of the hinge plates 10 which house the hinge pin 9 and secure the hinge plates to the shaft. The hinge plates 10 house a hinge pin 9 as shown in FIG. 9. As shown in FIG. 5, the opposing hinge plates house a spring 17 of the type shown in FIG. 6. The spring 17 is positioned so that its arms 19 and 20 lie parallel along the inside of the opposing hinge plates as illustrated in FIG. 5, thus applying outward pressure against the plates. The support rods 2 extend along the outside of the plates as is depicted in FIG. 1 and FIG. 5 resulting in the plates remaining in a closed, resting position. Each plate 10 contains a cup-like member 15 as is illustrated in FIG. 9. This cup-like member houses a ball-type member 14, which is integrally molded with cleaning head 22 of FIG. 10. When the rods are pulled rearward upon pressure to the handle assembly by the operator, they are removed from the exterior of the hinge plates 10 and the cleaning assembly 11 opens as is depicted in FIG. 2 to allow for cleaning of opposing surfaces.

Figure 10:
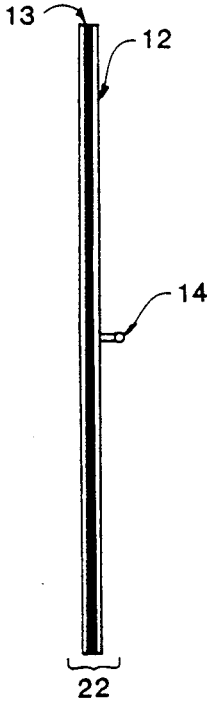
FIG. 10 is a side view of the preferred embodiment of the cleaning head of FIG. 1 and FIG. 4.

The cleaning head 22 of the device as shown in FIG. 10 consists of two open-ended, elongated channels 12 positioned perpendicular to the length of the shaft and so that the channels lie facing outwardly as is depicted clearly in FIG. 1. In the preferred embodiment, each of these channels houses a replaceable cleaning member 13 that may have an integrally molded portion which is capable of being inserted into either end of the channel to engage the channel and facilitate replacement. The cleaning member 13 may consist of a rubber blade of the type typically used in cleaning devices, or any other suitable material. When the cleaning assembly is extended, the cleaning surfaces 13 function to engage the surfaces to be cleaned. The ball and cup members of the cleaning assembly 11 then allow the cleaning members to continuously adjust for uniform and thorough cleaning.

Although the above description sets forth the preferred embodiment of the present invention to illustrate its use and objectives, it is understood that alternative embodiments may be fashioned without departing from the invention at hand.

What I claim as my invention is:

1. A device for cleaning a surface comprising an elongated shaft member having a series of support guides spaced along both sides of its length and integrally molded therewith, said guide housing cylindrical rods lying parallel to the length of the shaft and having at their distal end a perpendicular extension, said shaft having at its distal end a handle assembly consisting of a forward, stationary member integrally molded with said shaft and a movable rear member, said rear handle member connected to said handle assembly by means of a pivot pin and spring means, said rear member having a plurality of openings at its upper end and said rear member being attached to the shaft by means of a fastening mechanism, said fastening mechanism consisting of said openings in said rear handle member which receive said perpendicular extensions such that said extension extends through one said opening on each side of said rear handle member, said perpendicular extensions being secured in the openings by means of a fastening member, said elongated shaft further having at its other end a cleaning assembly wherein said cleaning assembly consists of two opposing hinge plates connected to the shaft by hinge means, said hinge means connected to said shaft by a hinge pin, said hinge plates housing spring means and having at their unconnected, free end a cup member which houses a ball-type member, said ball-type member integrally molded with an elongated, open-ended channel which houses a cleaning member, said cylindrical rods extending over the exterior of said hinge plates forcing the plates into a closed, resting position wherein movement of the rear handle member forward forces the cylindrical rods rearward thereby removing said cylindrical rods from the exterior of said hinge plates causing said spring housed inside said hinge plates to push the hinge plates and cleaning members into an open, operable position.

2. The cleaning device of claim 1 wherein the cleaning member consists of a rubber blade.

3. The cleaning device of claim 1 wherein the elongated shaft member has an opening at its distal end.

4. The cleaning device of claim 1 wherein said spring means connected to said handle members comprises a spring having a plurality of arms with one arm lying inside and extending within each handle member whereby said handle members are biased into an open, resting position.

5. The cleaning device of claim 1 wherein said spring means housed within said hinge plates comprises a spring having a plurality of arms with one arm lying parallel along the interior face of each opposing hinge plate whereby said hinge plates are biased outwardly.

6. The cleaning device of claim 1 wherein said ball and cup mechanism allows adjustment of the cleaning head relative to the surface being cleaned.

* * * * *